US009549241B2

(12) United States Patent
Lin

(10) Patent No.: US 9,549,241 B2
(45) Date of Patent: Jan. 17, 2017

(54) EARPHONE AND A METHOD FOR MAKING AN EARPHONE TO ACHIEVE AUTOMATIC IDENTIFICATION AND SWITCH CONTROL

(71) Applicant: Qingdao Goertek Technology Co., Ltd., Qingdao, ShanDong (CN)

(72) Inventor: Mengzhao Lin, Qingdao (CN)

(73) Assignee: Qingdao Goertek Technology Co., Ltd., Qingdao, ShanDong (CN)

( * ) Notice: Subject to any disclaimer, the term of this patent is extended or adjusted under 35 U.S.C. 154(b) by 0 days.

(21) Appl. No.: 14/650,707

(22) PCT Filed: Apr. 17, 2013

(86) PCT No.: PCT/CN2013/074320
§ 371 (c)(1),
(2) Date: Jun. 9, 2015

(87) PCT Pub. No.: WO2014/114033
PCT Pub. Date: Jul. 31, 2014

(65) Prior Publication Data

US 2015/0304764 A1 Oct. 22, 2015

(30) Foreign Application Priority Data

Jan. 25, 2013 (CN) ..... 2013 1 0029505

(51) Int. Cl.
*H04R 1/10* (2006.01)
*H04R 1/08* (2006.01)
(Continued)

(52) U.S. Cl.
CPC ..... *H04R 1/1091* (2013.01); *H04R 1/08* (2013.01); *H04R 1/1041* (2013.01); *H04R 3/00* (2013.01);
(Continued)

(58) Field of Classification Search
None
See application file for complete search history.

(56) References Cited

U.S. PATENT DOCUMENTS

2011/0170703 A1* 7/2011 Palma ..... H04R 1/1041 381/74
2013/0195283 A1* 8/2013 Larson ..... H04R 1/1041 381/74

FOREIGN PATENT DOCUMENTS

CN 1859813 11/2006
CN 101841586 9/2010
(Continued)

OTHER PUBLICATIONS

English machine translation of CN 101841753 (Qingyun et al., Drive-by-wire earphone for portable electronic equipment and method for realizing drive-by-wire, published Sep. 2010).*
(Continued)

*Primary Examiner* — Mark Fischer
(74) *Attorney, Agent, or Firm* — Boyle Fredrickson, S.C.

(57) ABSTRACT

The present invention discloses an earphone and a method for making an earphone to achieve automatic identification and switch control. The earphone comprises: a voltage-controlled switch, a switch button set, a microphone and more than two earphone remote control circuits, wherein different earphone remote control circuits correspond to different smartphone operating systems, respectively; the voltage-controlled switch is arranged between the switch button set, the microphone and the more than two earphone remote control circuits, and the voltage input terminal of the voltage-controlled switch is connected to the microphone-connected terminal of the earphone; the voltage-controlled switch identities the operating system of the smartphone that the earphone is plugged in according to the voltage of the microphone-connected terminal of the earphone, and then
(Continued)

controls switch(es) in itself to switch to a corresponding earphone remote control circuit, to achieve the connection of the switch button set and the microphone to the corresponding earphone remote control circuit. The technical solution of the present invention makes one earphone generally applicable to the mobile phones of different operating systems.

10 Claims, 1 Drawing Sheet

(51) Int. Cl.
*H04R 3/00* (2006.01)
*H04R 3/12* (2006.01)

(52) U.S. Cl.
CPC ..... *H04R 3/12* (2013.01); *H04R 2201/107* (2013.01); *H04R 2420/01* (2013.01); *H04R 2420/03* (2013.01)

(56) References Cited

FOREIGN PATENT DOCUMENTS

| | | |
|---|---|---|
| CN | 101841753 | 9/2010 |
| CN | 102196076 | 9/2011 |

OTHER PUBLICATIONS

PCT/CN2013/074320, Written Opinion of the International Searching Authority dated Oct. 2013, 4 pages and English Translation, 4 pages.

* cited by examiner

EARPHONE AND A METHOD FOR MAKING AN EARPHONE TO ACHIEVE AUTOMATIC IDENTIFICATION AND SWITCH CONTROL

TECHNICAL FIELD

The present invention relates to the technical field of earphone system, particularly relates to an earphone and a method for making an earphone to achieve automatic identification and switch control.

BACKGROUND ART

Smartphone operating system is a mobile phone system, whose computing power and functions are more powerful than the traditional mobile phone system. Most frequently used smartphone operating systems are iOS, Windows Phone and so on. The application software compatible with one operating system is not compatible with another operating system.

Current smartphones generally are equipped with matching earphones with remote control functions of volume increase (Vol +), volume reduction (Vol−), and Send/End. But each of the current earphones with remote control functions is only compatible with a certain smartphone operating system. For example, the earphones with remote control functions compatible with the mobile phone of iOS operating system can only be applied for the mobile phone of iOS operating system, rather than being applied for the mobile phone of another operating system. Similarly, the earphones with remote control functions compatible with the mobile phone of Windows Phone operating system can only be applied for the mobile phone of Windows Phone operating system, rather than being applied for the mobile phone of another operating system.

SUMMARY OF THE INVENTION

In view of this, the present invention provides an earphone and a method for making an earphone to achieve automatic identification and switch control, to obtain an earphone generally applied for the mobile phones of various operating systems.

For this purpose, the technical solution of the present invention can be achieved as follows:

- the present invention discloses an earphone comprising a voltage-controlled switch, a switch button set, a microphone and more than two earphone remote control circuits, wherein different earphone remote control circuits correspond to different smartphone operating systems, respectively;
- the voltage-controlled switch is arranged between the switch button set, the microphone and the more than two earphone remote control circuits, and the voltage input terminal of the voltage-controlled switch is connected to the microphone-connected terminal of the earphone;
- the voltage-controlled switch identifies the operating system of the smartphone that the earphone is plugged in according to the voltage of the microphone-connected terminal of the earphone, and then controls switch(es) in itself to switch to a corresponding earphone remote control circuit, to achieve the connection of the switch button set and the microphone to the corresponding earphone remote control circuit.

Optionally, the different smartphone operating systems correspond to different voltage ranges, respectively; the voltage-controlled switch identifies the operating system of the smartphone that the earphone is plugged in according to the voltage range that the voltage value of the microphone-connected terminal of the earphone falls into, and then control the switch(es) in itself to switch to the corresponding earphone remote control circuit.

Optionally, the earphone comprises two earphone remote control circuits, respectively as the earphone remote control circuit corresponding to iOS operating system and the earphone remote control circuit corresponding to Windows Phone operating system.

Optionally, the voltage-controlled switch comprises three switches, each comprising a fixed contact, a first switch contact, a second switch contact and a switch electrode connected to the fixed contact; when the voltage of the voltage input terminal is lower than a reference voltage, the voltage-controlled switch controls the switch electrode in each switch to switch to the first switch contact; conversely, when the voltage of voltage input terminal is higher than the reference voltage, the voltage-controlled switch controls the switch electrode in each switch to switch to the second switch contact.

Optionally, the voltage-controlled switch comprises a comparison control module; one input terminal of the comparison control module is connected to the reference voltage, the other input terminal of the comparison control module is connected to the voltage input terminal, the output control terminal of the comparison control module is connected to the three switches, respectively.

Optionally, the switch button set comprises: a Send/End switch button S0, a volume increase switch button S1 and a volume reduction switch button S2;

- wherein one terminal of S0 is connected to the ground terminal of the earphone, and the other terminal of S0 is connected to the microphone-connected terminal of the earphone; one terminal of S1 is connected to the ground terminal of the earphone, and the other terminal of S1 is connected to the fixed contact of the first switch in the voltage-controlled switch; one terminal of S2 is connected to the ground terminal of the earphone, and the other terminal of S2 is connected to the fixed contact of the second switch in the voltage-controlled switch.

Optionally, the earphone remote control circuit corresponding to iOS operating system comprises: a first resistor, a second resistor, an N channel FET and a "Mikey Chip" chip;

- wherein the "Mikey Chip" chip is connected to the microphone-connected terminal of the earphone, one terminal of the first resistor and the gate of the N channel FET, respectively; the other terminal of the first resistor is connected to one terminal of the second resistor, and the other terminal of the first resistor is also connected to the second switch contact of the first switch in the voltage-controlled switch; the other terminal of the second resistor is connected to the second switch contact of the second switch in the voltage-controlled switch; the source of the N channel FET is connected to the ground terminal of the earphone, the drain of the N channel FET is connected to the second switch contact of the third switch in the voltage-controlled switch;
- one terminal of the microphone is connected to the microphone-connected terminal of the earphone, the other terminal of the microphone is connected to the fixed contact of the third switch in the voltage-controlled switch.

Optionally, the earphone remote control circuit corresponding to Windows Phone operating system comprises a third resistor and a fourth resistor;

wherein one terminal of the third resistor is connected to the microphone-connected terminal of the earphone; the other terminal of the third resistor is connected to one terminal of the fourth resistor; the other terminal of the third resistor is also connected to the first switch contact of the first switch in the voltage-controlled switch; the other terminal of the fourth resistor is connected to the first switch contact of the second switch in the voltage-controlled switch; the first switch contact of the third switch in the voltage-controlled switch is connected to the ground terminal of the earphone;

one terminal of the microphone is connected to the microphone-connected terminal of the earphone, the other terminal of the microphone is connected to the fixed contact of the third switch in the voltage-controlled switch.

Optionally, the first resistor has a resistance value of 6.8 kΩ; the second resistor has a resistance value of 2.61 kΩ; the third resistor has a resistance value of 221Ω; the fourth resistor has a resistance value of 392Ω.

Optionally, the voltage value of the reference voltage is +1.9V.

The present invention also discloses a method for making an earphone to achieve automatic identification and switch control, the method comprises:

arranging a voltage-controlled switch, a switch button set, a microphone and more than two earphone remote control circuits in the earphone, wherein different earphone remote control circuits correspond to different smartphone operating systems, respectively;

arranging the voltage-controlled switch between the switch button set and the microphone and the more than two earphone remote control circuits, and connecting the voltage input terminal of the voltage-controlled switch to the microphone-connected terminal of the earphone;

the voltage-controlled switch identifies the operating system of the smartphone that the earphone is plugged in according to the voltage of the microphone-connected terminal of the earphone, controls switch(es) in itself to switch to a corresponding earphone remote control circuit, to achieve the connection of the switch button set and the microphone to the corresponding earphone remote control circuit.

Thus it is seen that the earphone of the present invention comprises a voltage-controlled switch, a switch button set, a microphone and more than two earphone remote control circuits, wherein different earphone remote control circuits correspond to different smartphone operating systems, respectively; the voltage-controlled switch is arranged between the switch button set, the microphone and the more than two earphone remote control circuits, and the voltage input terminal of the voltage-controlled switch is connected to the microphone-connected terminal of the earphone; the voltage-controlled switch identifies the operating system of the smartphone that the earphone is plugged in according to the voltage of the microphone-connected terminal of the earphone, controls switch(es) in itself to switch to a corresponding earphone remote control circuit, to achieve the technical solution of connection of the switch button set and the microphone to the corresponding earphone remote control circuit, in order to make an earphone generally applicable for the mobile phones of different operating systems.

DETAILED DESCRIPTION OF THE INVENTION

Figure 1:
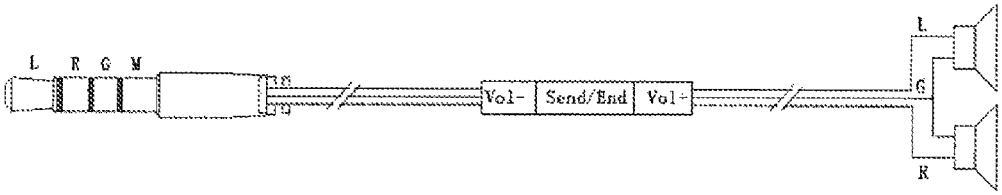
FIG. 1 is a schematic view of an earphone in an Example of the present invention.

The core of the present invention is: arranging a voltage-controlled switch, a switch button set, a microphone and more than two earphone remote control circuits in an earphone, wherein different earphone remote control circuits correspond to different smartphone operating systems, respectively; arranging the voltage-controlled switch between the switch button set and the microphone and the more than two earphone remote control circuits, and connecting the voltage input terminal of the voltage-controlled switch to the microphone-connected terminal of the earphone; the voltage-controlled switch can identify the operating system of the smartphone that the earphone is plugged in according to the voltage of the microphone-connected terminal of the earphone, control switch(es) in itself to switch to a corresponding earphone remote control circuit, to achieve the connection of the switch button set and the microphone to the corresponding earphone remote control circuits.

The present invention mainly takes advantage of the difference of input voltage of the microphone-connected terminal (M electrode) of an earphone in different smartphone operating systems, and uses a voltage-controlled switch to identify the different voltages, identify the type of the corresponding mobile phone operating system, and then adjusts the configuration of the earphone automatically, to be compatible with the current corresponding mobile phone operating system.

To make the purpose, technical solution and advantages of the present invention clearer, detailed description of embodiments of the present invention will be provided in combination with attached figures as follows.

The earphone in the Example of the present invention comprises: a voltage-controlled switch, a switch button set, a microphone and more than two earphone remote control circuits, wherein different earphone remote control circuits correspond to different smartphone operating systems, respectively; the voltage-controlled switch is arranged between the switch button set, the microphone and the more than two earphone remote control circuits, and the voltage input terminal of the voltage-controlled switch is connected to the microphone-connected terminal of the earphone; the voltage-controlled switch identifies the operating system of the smartphone that the earphone is plugged in according to the voltage of the microphone-connected terminal of the earphone, and then controls switch(es) in itself to switch to a corresponding earphone remote control circuit, to achieve the connection of the switch button set and the microphone to the corresponding earphone remote control circuit.

In one Example of the present invention, specifically: the different smartphone operating systems correspond to different voltage ranges, respectively; the voltage-controlled switch can identify the operating system of the smartphone that the earphone is plugged in according to the voltage range that the voltage value of the microphone-connected terminal of the earphone falls into, and then control switch (es) in itself to switch to a corresponding earphone remote control circuit.

For example, the earphone comprises three earphone remote control circuits, respectively corresponding to three smartphone operating systems, in which the corresponding voltage range of the first smartphone operating system is +1.5V~+1.9V, the corresponding voltage range of the second smartphone operating system is +2.0V~+2.5V, the corresponding voltage range of the third smartphone operating system is +2.6V~+3.5V. If the voltage of the microphone-connected terminal of the earphone is 2.1V, that falls into the range of +2.0V~+2.5V, it is possible to determine that the operating system of the smartphone that the earphone is plugged in is the second smartphone operating system, and switch the switch to the earphone remote control circuit corresponding to the second smartphone operating system, to make it connected to the switch buttons, and so on.

The technical solution of the present invention will be described in details as follows by an example of a 4-pin 3.5 mm earphone, which can be generally applied to the iOS operating system mobile phone and the Windows Phone operating system mobile phone.

FIG. 1 is a schematic view of an earphone in an Example of the present invention. As shown in FIG. 1, the earphone is a 4-pin 3.5 mm earphone, in which R represents the right channel terminal, L represents the left channel terminal, G represents the ground terminal, M represents the microphone-connected terminal, Vol+ represents the volume increase switch button, Vol− represents the volume reduction switch button. Send/End represents the Send and End switch button.

Figure 2:
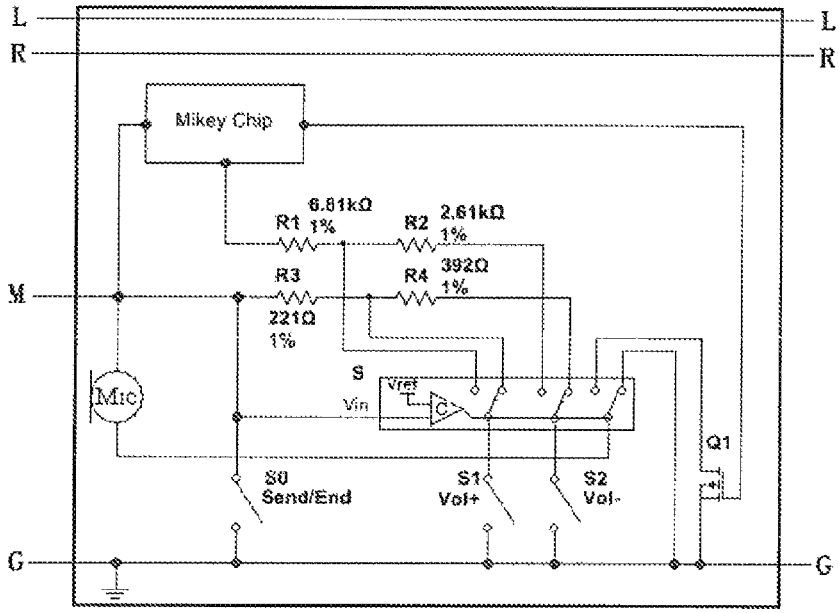
FIG. 2 is a schematic view of circuit configuration achieving identification and switch control in the earphone in the Example of the present invention.

FIG. 2 is a schematic view of circuit configuration achieving identification and switch control in the earphone in the Example of the present invention. The earphone in the present Example can be generally applied to the iOS operating system mobile phone and the Windows Phone operating system mobile phone.

Referring to FIG. 2, the configuration comprises: a voltage-controlled switch S, a Send/End switch button S0, a volume increase switch button S1, a volume reduction switch button S2, a microphone Mic, an earphone remote control circuit corresponding to iOS operating system and an earphone remote control circuit corresponding to Windows Phone operating system.

Referring to FIG. 2, the voltage input terminal of the voltage-controlled switch S is connected to the microphone-connected terminal M of the earphone, a reference voltage is provided inside the voltage-controlled switch S, in one Example of the present invention, the reference voltage is +1.9V, In other Examples of the present invention, the voltage-controlled switch can be connected to a reference voltage externally, the value of the reference voltage can be modified flexibly. The voltage-controlled switch S comprises three switches, in a turn from left to right as a first switch, a second switch and a third switch. Each switch comprises: a fixed contact 0, a first switch contact 1, a second switch contact 2 and a switch electrode connected to the fixed contact 0. The voltage-controlled switch S is a chip, having a control logic per se, in the present Example, when the voltage of voltage input terminal is lower than the reference voltage, the voltage-controlled switch controls the switch electrode in each switch to switch to the first switch contact 1; conversely, when the voltage of voltage input terminal is higher than the reference voltage, the voltage-controlled switch controls the switch electrode in each switch to switch to the second switch contact 2. Alternatively, in the other Examples of the present invention, when the voltage value at the voltage input terminal falls into the first pre-determined voltage range which is lower than the reference voltage, the voltage-controlled switch S controls the switch electrode in each switch to switch to the first switch contact 1; conversely, when the voltage value at the voltage input terminal falls into the second pre-determined voltage range which is higher than the reference voltage, the voltage-controlled switch S controls the switch electrode in each switch to switch to the second switch contact 2. For example, the reference voltage is +1.9V, the first pre-determined voltage range is +1.5V~+1.8V, the second pre-determined voltage range is +2.0V~2.3V.

In the Example, the voltage-controlled switch S comprises a comparison control module C; one input terminal of the comparison control module C is connected to the reference voltage Vref, the other input terminal of the comparison control module C is connected to the voltage input terminal Vin, the output control terminal of comparison control module C is connected to the three switches, respectively. Thus, the comparison of the voltage of voltage input terminal and the reference voltage is achieved by the comparison control module C, and the three switches are controlled based on the comparison result.

One terminal of S0 is connected to the ground terminal G of the earphone, and the other terminal of S0 is connected to the microphone-connected terminal M of the earphone. One terminal of S1 is connected to the ground terminal G of the earphone, and the other terminal of S1 is connected to the fixed contact 0 of the first switch in the voltage-controlled switch S; one terminal of S2 is connected to the ground terminal G of the earphone, and the other terminal of S2 is connected to the fixed contact 0 of the second switch in the voltage-controlled switch S.

In the Example, the earphone remote control circuit corresponding to iOS operating system comprises: a first resistor R1, a second resistor R2, an N channel FET Q1 and a "Mikey Chip" chip. The "Mikey Chip" chip is a specified chip in the remote earphone of Apple mobile phone. The "Mikey Chip" chip is connected to the microphone-connected terminal M of the earphone, one terminal of the first resistor R1 and the gate of the N channel FET Q1, respectively. The other terminal of the first resistor R1 is connected to one terminal of the second resistor R, and the other terminal of the first resistor R1 is also connected to the second switch contact 2 of the first switch in the voltage-controlled switch S. The other terminal of the second resistor R2 is connected to the second switch contact 2 of the second switch in the voltage-controlled switch S. The source of the N channel FET Q1 is connected to the ground terminal G of the earphone, the drain of the N channel FET Q1 is connected to the second switch contact 2 of the third switch in the voltage-controlled switch S. In the Example, the first resistor R1 has a resistance value of 6.8 kΩ; the second resistor R2 has a resistance value of 2.61 kΩ. Herein the earphone remote control circuit corresponding to iOS operating system is the same as the earphone remote control circuit in the remote earphone of Apple mobile phone in the prior art, so the working principle of the earphone remote control circuit will not be described.

One terminal of the microphone Mic is connected to the microphone-connected terminal M of the earphone, the other terminal of the microphone Mic is connected to the fixed contact 0 of the third switch in the voltage-controlled switch S.

In the Example of the present invention, the earphone remote control circuit corresponding to Windows Phone operating system comprises: a third resistor R3 and a fourth resistor R4. The third resistor R3 has a resistance value of 221Ω, the fourth resistor R4 has a resistance value of 392Ω. The 1% in FIG. 2 indicates precision. The earphone remote control circuit is the same as the earphone remote control circuit in the remote earphone of the current mobile phone of Windows Phone operating system, so the working principle of the earphone remote control circuit will not be described. In the Example of the present invention, one terminal of the third resistor R3 is connected to the microphone-connected terminal M of the earphone; the other terminal of the third resistor R3 is connected to one terminal of the fourth resistor R4; the other terminal of the third resistor R3 is also connected to the first switch contact 1 of the first switch in the voltage-controlled switch S. The other terminal of the fourth resistor R4 is connected to the first switch contact 1 of the second switch in the voltage-controlled switch S. The first switch contact 1 of the third switch in the voltage-controlled switch S is connected to the ground terminal G of the earphone.

When the plug of the earphone comprising the circuit configuration shown in FIG. 2 is plugged in the jack of the mobile phone, and the voltage-controlled switch S detects that the voltage value of the microphone-connected terminal M is lower than +1.9V, all the switch electrodes of the three switches in the voltage-controlled switch S switch to the switch contact 1, the voltage-controlled switch S is connected to the third resistor R3 and the fourth resistor R4, and switches to the earphone remote control circuit of Windows Phone operating system, thus the buttons S0, S1 and S2 carry on the control manipulation of Windows Phone operating system.

When the plug of the earphone comprising the circuit configuration shown in FIG. 2 is plugged in the jack of mobile phone, and the voltage-controlled switch S detects that the voltage value of the microphone-connected terminal M is higher than +1.9V, all the switch electrodes of the three switches in the voltage-controlled switch S switch to the switch contact 2, the voltage-controlled switch S is connected to the first resistor R1, the second resistor R2 and the N channel FET Q1, and switches to the earphone remote control circuit of iOS operating system, thus the buttons S0, S1 and S2 carry on the control manipulation of iOS operating system.

Thus it can be seen that the circuit configuration shown in FIG. 2 can make an earphone generally applied to the Windows Phone operating system mobile phone and the iOS operating system mobile phone.

The example shown in FIG. 2 demonstrates the control structure of the remote earphone, which can be generally applied to the Windows Phone operating system mobile phone and the iOS operating system mobile phone. But the present invention is not restricted to that. In other examples of the present invention, other smartphone operating systems are available, as long as the earphone remote control circuit of the corresponding smartphone operating system is installed in the structure correspondingly. Furthermore, the number of the installed earphone remote control circuits is not restricted to two, it may be more than two, as long as the number of switches in the voltage-controlled switch, the number of switch contacts in each switch, and the logic that performs control based on the voltage are designed. That is to say, the voltage-controlled switch is arranged between the switch button set, the microphone and the more than two earphone remote control circuits, and the voltage input terminal of the voltage-controlled switch is connected to the microphone-connected terminal of the earphone, the voltage-controlled switch identifies the operating system of the smartphone that the earphone is plugged in according to the voltage of the microphone-connected terminal of the earphone, and controls switch(es) in itself to switch to a corresponding earphone remote control circuit, to achieve the connection of the switch button set and the microphone to the corresponding earphone remote control circuit. In this way, an earphone generally applied for the smartphones having any operating system can be obtained.

Hereinbefore are merely the preferable examples of the present invention, which are not for restricting the protection scope of the present invention. That is, any modifications, equivalent substitutions and improvements without departing from the spirit and scope of the present invention are within the protection scope of the present invention.

What is claimed:

1. An earphone, characterized in that, the earphone comprises: a voltage-controlled switch, a switch button set, a microphone and more than two earphone remote control circuits, wherein the earphone remote control circuits correspond to different smartphone operating systems, respectively;

the voltage-controlled switch is arranged between the switch button set, the microphone and the more than two earphone remote control circuits, and a voltage input terminal of the voltage-controlled switch is connected to a microphone-connected terminal of the earphone;

the voltage-controlled switch identifies an operating system of a smartphone that the earphone is plugged in according to the voltage of the microphone-connected terminal of the earphone, and then controls switch(es) in itself to switch to a corresponding one of the earphone remote control circuit, to achieve a connection of the switch button set and the microphone to the corresponding one of the earphone remote control circuit.

2. The earphone according to claim 1, characterized in that, the different smartphone operating systems correspond to different voltage ranges, respectively;

the voltage-controlled switch identifies the operating system of the smartphone that the earphone is plugged in according to the voltage range that the voltage of the microphone-connected terminal of the earphone falls into, and then controls the switch(es) in itself to switch to the corresponding earphone remote control circuit.

3. The earphone according to claim 1, characterized in that, the earphone comprises two earphone remote control circuits, respectively as the earphone remote control circuit corresponding to an iOS operating system and the earphone remote control circuit corresponding to a Windows Phone operating system.

4. The earphone according to claim 3, characterized in that, the voltage-controlled switch comprises three switches, each comprising a fixed contact, a first switch contact, a second switch contact and a switch electrode connected to the fixed contact;

when a voltage of the voltage input terminal is lower than a reference voltage, the voltage-controlled switch controls the switch electrode in each of the three switches to switch to the first switch contact; conversely, when the voltage of the voltage input terminal is higher than the reference voltage, the voltage-controlled switch controls the switch electrode in each of the three switches to switch to the second switch contact.

5. The earphone according to claim 4, characterized in that, the voltage-controlled switch comprises a comparison control module;

one input terminal of the comparison control module is connected to the reference voltage, another input terminal of the comparison control module is connected to the voltage input terminal, an output control terminal of the comparison control module is connected to the three switches, respectively.

6. The earphone according to claim 4, characterized in that, the switch button set comprises: a Send/End switch button S0, a volume increase switch button S1 and a volume reduction switch button S2;

wherein one terminal of S0 is connected to a ground terminal of the earphone, and another terminal of S0 is connected to the microphone-connected terminal of the earphone; one terminal of S1 is connected to the ground terminal of the earphone, and another terminal of S1 is connected to the fixed contact of a first of the three switches; one terminal of S2 is connected to the ground terminal of the earphone, and another terminal of S2 is connected to the fixed contact of a second of the three switches.

7. The earphone according to claim 6, characterized in that, the earphone remote control circuit corresponding to the iOS operating system comprises: a first resistor, a second resistor, an N channel FET and a "Mikey Chip" chip;

wherein the "Mikey Chip" chip is connected to the microphone-connected terminal of the earphone, one terminal of the first resistor and a gate of the N channel FET, respectively; another terminal of the first resistor is connected to one terminal of the second resistor, and the other terminal of the first resistor is also connected to the second switch contact of the first of the three switches; another terminal of the second resistor is connected to the second switch contact of the second of the three switches; a source of the N channel FET is connected to the ground terminal of the earphone, a drain of the N channel FET is connected to the second switch contact of a third of the three switches;

one terminal of the microphone is connected to the microphone-connected terminal of the earphone, another terminal of the microphone is connected to the fixed contact of the third of the three switches.

8. The earphone according to claim 7, characterized in that the earphone remote control circuit corresponding to the Windows Phone operating system comprises: a third resistor and a fourth resistor;

wherein one terminal of the third resistor is connected to the microphone-connected terminal of the earphone; another terminal of the third resistor is connected to one terminal of the fourth resistor; the other terminal of the third resistor is also connected to the first switch contact of the first of the three switches; another terminal of the fourth resistor is connected to the first switch contact of the second of the three switches; the first switch contact of the third of the three switches is connected to the ground terminal of the earphone.

9. The earphone according to claim 8, characterized in that, the first resistor has a resistance value of 6.8 kΩ;

the second resistor has a resistance value of 2.61 kΩ;

the third resistor has a resistance value of 221Ω;

the fourth resistor has a resistance value of 392Ω.

10. A method for making an earphone to achieve automatic identification and switch control, characterized in that, the method comprises:

arranging a voltage-controlled switch, a switch button set; a microphone and more than two earphone remote control circuits in the earphone, wherein the earphone remote control circuits correspond to different smartphone operating systems, respectively;

arranging the voltage-controlled switch between the switch button set and the microphone and the more than two earphone remote control circuits, and connecting a voltage input terminal of the voltage-controlled switch to a microphone-connected terminal of the earphone;

the voltage-controlled switch identifies an operating system of a smartphone that the earphone is plugged in according to the voltage of the microphone-connected terminal of the earphone, controls switch(es) in itself to switch to a corresponding one of the earphone remote control circuit, to achieve a connection of the switch button set and the microphone to the corresponding one of the earphone remote control circuit.

* * * * *